US011338945B2

(12) United States Patent
Furlotti

(10) Patent No.: US 11,338,945 B2
(45) Date of Patent: May 24, 2022

(54) MIXING-DOSAGE APPARATUS FOR ROTARY PACKAGING MACHINES

(71) Applicant: I.M.A. INDUSTRIA MACCHINE AUTOMATICHE S.P.A., Bologna (IT)

(72) Inventor: Filippo Furlotti, Traversetolo (IT)

(73) Assignee: I.M.A. INDUSTRIA MACCHINE AUTOMATICHE S.P.A., Bologna (IT)

( * ) Notice: Subject to any disclaimer, the term of this patent is extended or adjusted under 35 U.S.C. 154(b) by 225 days.

(21) Appl. No.: 16/623,114

(22) PCT Filed: Jun. 11, 2018

(86) PCT No.: PCT/EP2018/065371

§ 371 (c)(1),
(2) Date: Dec. 16, 2019

(87) PCT Pub. No.: WO2018/229002

PCT Pub. Date: Dec. 20, 2018

(65) Prior Publication Data

US 2020/0216202 A1 Jul. 9, 2020

(30) Foreign Application Priority Data

Jun. 14, 2017 (IT) ..... 102017000065679

(51) Int. Cl.

| | |
|---|---|
| ***B65B 3/32*** | (2006.01) |
| ***B01F 13/08*** | (2006.01) |
| ***B01F 15/02*** | (2006.01) |
| ***B01F 7/00*** | (2006.01) |

(Continued)

(52) U.S. Cl.

CPC ..... *B65B 3/323* (2013.01); *B01F 27/50* (2022.01); *B01F 33/452* (2022.01);

(Continued)

(58) Field of Classification Search

CPC ..... B65B 3/323; B65B 3/326; B65B 37/20; B65B 25/00; B65B 2220/14; B65B 1/385;

(Continued)

(56) References Cited

U.S. PATENT DOCUMENTS 4,913,202 A * 4/1990 Miller ..... B67C 3/001 141/258
5,361,560 A * 11/1994 Sandolo ..... A23F 5/465 141/11

(Continued)

FOREIGN PATENT DOCUMENTS

CN 101952173 A 1/2011
CN 204223210 U 3/2015

(Continued)

OTHER PUBLICATIONS

International Search Report dated Sep. 27, 2018 re: Application No. PCT/EP2018/065371, pp. 1-5, citng: EP 2 233 201 A2, US 2004/0020941 A1 and US 2009/0293985 A1.

(Continued)

*Primary Examiner* — Andrew M Tecco
*Assistant Examiner* — Nicholas E Igbokwe
(74) *Attorney, Agent, or Firm* — Cantor Colburn LLP

(57) ABSTRACT

A mixing-dosage apparatus for rotary machines for packaging containers includes a mixing portion and a dosage portion. The two portions have a selective fluid connection using a flow control valve, which acts between the two portions so as to feed the dosage duct with consecutive loads of mixed food mass. Each load has a volume that is approximately equal to the volume of the mixing chamber.

10 Claims, 2 Drawing Sheets

(51) Int. Cl.

| | |
|---|---|
| ***B65B 25/00*** | (2006.01) |
| ***B65B 37/20*** | (2006.01) |
| ***B01F 27/50*** | (2022.01) |
| ***B01F 33/452*** | (2022.01) |
| ***B01F 35/75*** | (2022.01) |
| *B01F 101/07* | (2022.01) |

(52) U.S. Cl.
CPC ..... *B01F 35/75471* (2022.01); *B65B 3/326* (2013.01); *B65B 25/00* (2013.01); *B65B 37/20* (2013.01); *B01F 2101/07* (2022.01); *B65B 2220/14* (2013.01)

(58) Field of Classification Search
CPC ..... B01F 15/0291; B01F 15/0293; B01F 13/0818; B01F 2215/0006; B01F 7/00908
See application file for complete search history.

(56) References Cited

U.S. PATENT DOCUMENTS

| | | | | |
|---|---|---|---|---|
| 5,433,967 | A * | 7/1995 | Kateman | A23G 9/04 222/1 |
| 2003/0189872 | A1* | 10/2003 | Artman | A47J 31/401 366/165.3 |
| 2004/0020941 | A1 | 2/2004 | Engesser et al. | |
| 2009/0293985 | A1 | 12/2009 | Till et al. | |
| 2010/0300580 | A1* | 12/2010 | Macquet | B65B 3/326 141/83 |
| 2013/0220481 | A1* | 8/2013 | Hartel | B67C 3/208 141/9 |
| 2017/0347690 | A1* | 12/2017 | Benedetti | B67D 1/0021 |

FOREIGN PATENT DOCUMENTS

| | | | | |
|---|---|---|---|---|
| CN | 105314135 | A | 2/2016 | |
| CN | 206050127 | U * | 3/2017 | B65B 3/28 |
| CN | 206050127 | U | 3/2017 | |
| DE | 20118915 | U1 | 3/2003 | |
| EP | 2233201 | A2 | 9/2010 | |
| WO | 2007023055 | A1 | 3/2007 | |

OTHER PUBLICATIONS

Written Opinion dated Sep. 27, 2018 re: Application No. PCT/EP2018/065371, pp. 1-8, citng: EP 2 233 201 A2.

* cited by examiner

MIXING-DOSAGE APPARATUS FOR ROTARY PACKAGING MACHINES

TECHNICAL FIELD

The present disclosure relates to a mixing-dosage apparatus for rotary packaging machines, but also to a rotary mixing-dosage station preferably comprising said apparatus and to a mixing-dosage method which uses said apparatus.

BACKGROUND

Linear mixing and dosage stations for food, usually installed in packaging lines with fixed stations, are known in the prior art.

These stations are provided with a mixing-dosage apparatus in a fixed position and are designed to provide a kind of food (with which a container is filled) by mixing various ingredients, such as a liquid or semiliquid base (for example yogurt, milk or the like) and at least one secondary ingredient (for example fruit in chunks, chocolate in flakes, syrup or the like).

For this purpose, these apparatuses comprise a mixer portion which has a fluid connection to a dispensing valve, which is opened and closed alternately when the container to be filled passes. In order to achieve a good amalgamation of the ingredients, the mixer portion comprises a helical mixing element which operates in a mixing or blending volume, into which the ingredients are fed separately.

In the known applications of these mixers, the containers are fed to a fixed filling station and this requires stepwise, i.e. discontinuous, operation of the packaging line.

Furthermore, a rather widespread drawback is linked to blending, which requires a certain technical time in order to lead to a good result in terms of uniform distribution of the secondary ingredient in the liquid or semiliquid base before filling the container.

Achieving this result in fact entails limiting the advancement rate of the containers that are in each instance coupled to the dispensing valve, decreasing as a whole the efficiency of the machine.

Besides, this situation cannot be improved by providing larger mixing volumes, since this would entail, at the end of the cycle, an unacceptable loss of product. The same can be said if one considers increasing the speed of the helical elements, since an excessive speed could easily damage the ingredients, especially when the secondary one comprises fruit.

SUMMARY

The aim of the present disclosure is to provide a mixing-dosage apparatus for rotary packaging machines and a corresponding packaging machine which are capable of improving the prior art in one or more of the aspects indicated above.

Within this aim, the disclosure achieves high packaging efficiency.

The disclosure also obtains uniform mixing while avoiding damaging the ingredients.

The present disclosure provides a mixing-dosage apparatus for rotary packaging machines (and a corresponding packaging machine) that is mechanically relatively simple and sturdy.

The disclosure further provides a mixing-dosage apparatus for rotary packaging machines (and a corresponding packaging machine) capable of giving the greatest assurances of reliability and safety in use.

The disclosure also provides a mixing-dosage apparatus for rotary packaging machines (and a corresponding packaging machine) that is easy to provide and economically competitive if compared with the prior art.

Furthermore, the present disclosure overcomes the drawbacks of the prior art in a manner that is alternative to any existing solutions.

This aim, these advantages and others which will become better apparent hereinafter are achieved by a mixing-dosage apparatus for rotary machines for packaging containers that can each be filled with a single dose of mixed food mass, comprising at least one first ingredient and one second ingredient, the apparatus comprising:

- a mixing portion, comprising a mixing chamber and a mixer which is active in the mixing chamber for mixing or blending the ingredients into a mixed food mass,
- a dosage portion, comprising a dosage duct and a dispensing valve that affects a free end of the dosage duct to dispense the single dose of mixed food mass in the container, wherein, according to the disclosure, the mixing portion and the dosage portion have a selective fluid connection, a flow control valve being provided between the two portions, so as to feed the dosage duct with consecutive loads of mixed food mass, each load having a volume that is approximately equal to the volume of the mixing chamber.

In this manner, a direct connection between the mixing portion and the dosage portion is avoided and it is possible to perform a "load-based" (also known as "batch") operation which allows to mix more uniformly the ingredients, which remain stably in the mixing chamber for a certain time.

The aim and advantages of the disclosure are also achieved by providing a rotary mixing-dosage station for container packaging lines, wherein the apparatus includes:

- at least one first tank for a first ingredient and at least one second tank for a second ingredient;
- a carousel that can rotate about a vertical axis and is provided, along its peripheral region, with a plurality of filling nozzles associated with respective devices for supporting the containers, wherein each one of said nozzles is connected to said at least one first tank and to said at least one second tank at least through a respective mixing portion which is fixed to said carousel and comprises a mixing chamber and a mixer which is active in the mixing chamber in order to mix or blend said first and second ingredients into a mixed food mass that can be dispensed from said nozzle.

The disclosure also relates to a mixing-dosage method in a packaging machine, characterized in that it is performed in said mixing-dosage apparatus and in that it comprises the steps of:

-a- introducing at least two ingredients in the mixing chamber,

-b- mixing said ingredients with the mixer in order to generate a load of mixed food mass, -c- transferring the entire load of mixed food mass into the dosage portion, simultaneously feeding new ingredients into said mixing chamber, -d- dispensing from the dosage portion individual doses of mixed food mass to a container.

BRIEF DESCRIPTION OF THE DRAWINGS

Further characteristics and advantages of the disclosure will become better apparent from the description of a preferred but not exclusive embodiment of the mixing-dosage apparatus for rotary packaging machines and of the mixing-dosage station according to the disclosure, illustrated by way of non-limiting example with the aid of the accompanying drawings, wherein.

DETAILED DESCRIPTION OF THE DRAWINGS

Figure 1:
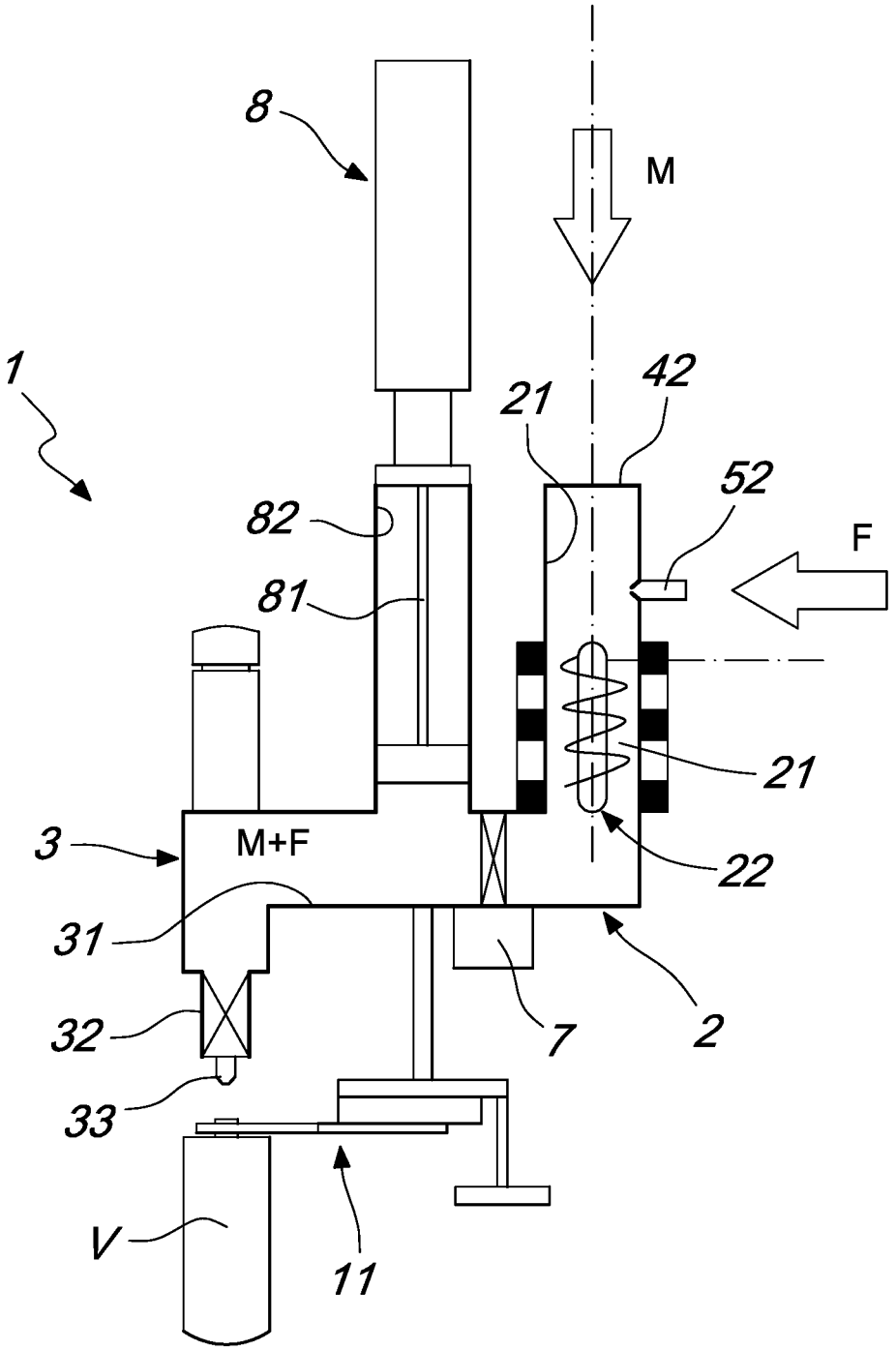
FIG. 1 is a schematic sectional view of a preferred embodiment of a mixing-dosage apparatus according to the disclosure.
Figure 2:
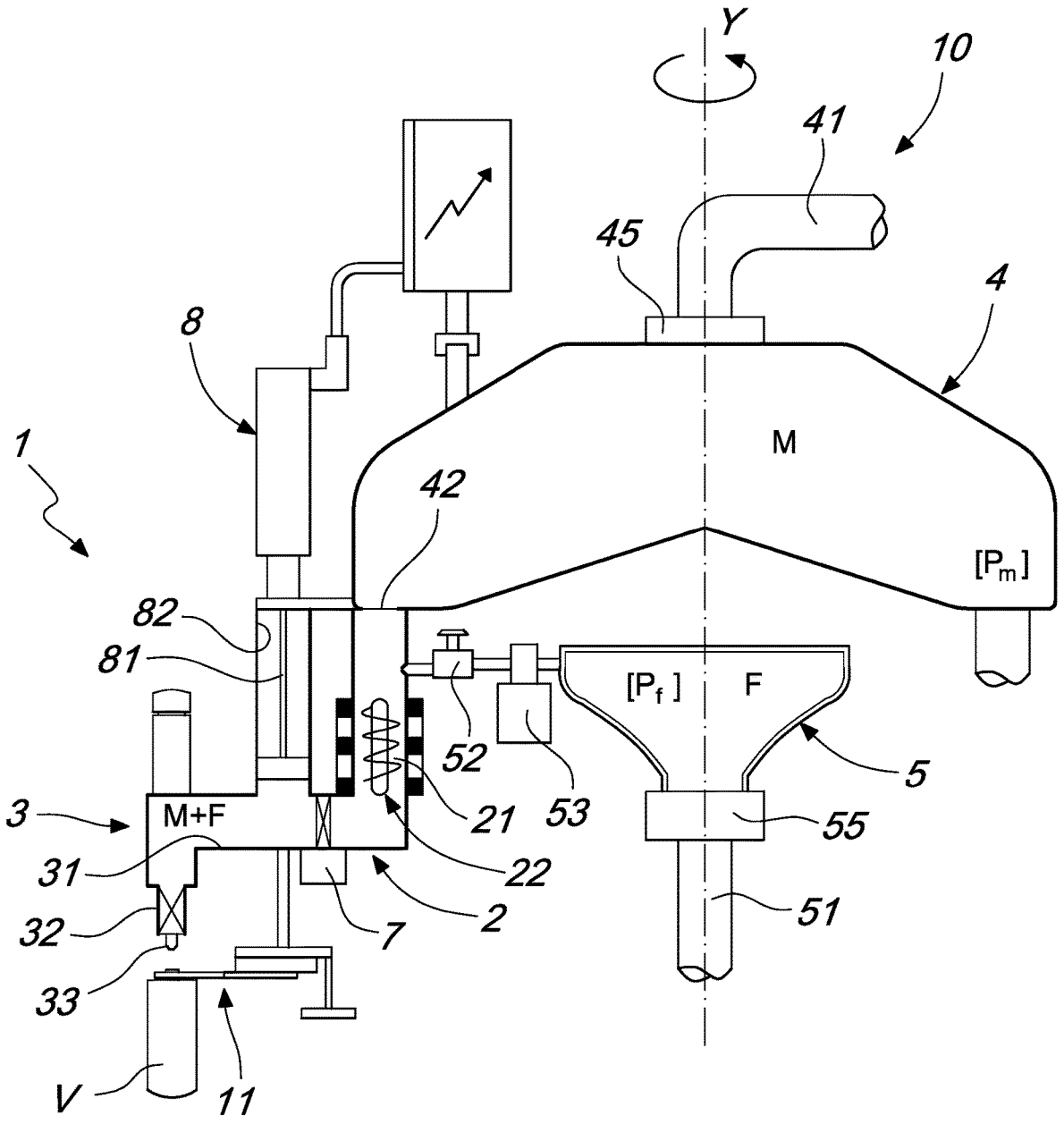
FIG. 2 is a schematic sectional view of a preferred embodiment of a mixing-dosage station which comprises the apparatus of the preceding figure.

With reference to FIGS. 1 and 2, the mixing-dosage apparatus, generally designated by the reference numeral 1, is described first.

The mixing-dosage apparatus 1 is designed to be installed on rotary machines for the packaging of containers V which must be each filled with a single dose of mixed food mass M+F.

Generally speaking, the mixed food mass comprises at least one first ingredient M—for example milk—and a second ingredient F—for example, chunks of fruit.

The apparatus 1 comprises a mixing portion 2, which in turn comprises a mixing chamber 21 and a mixer 22 which is active in the mixing chamber 21 in order to mix or blend the ingredients M and F, which reach the chamber 21 preferably separately, for example through respective feeding ducts or from tanks 4 and 5 (which will be described in greater detail hereinafter). In the mixing chamber 21, the ingredients are mixed and amalgamated until a mixed food mass M+F that is as uniform as possible is obtained.

The apparatus 1 comprises furthermore a dosage portion 3, which comprises a dosage duct 31 and a dispensing valve 32 which affects a free end of the dosage duct 31 in order to dispense a single dose of mixed food mass M+F into the container V through a nozzle 33.

The dosage portion 3 is arranged downstream of the mixing portion 2, so that it is crossed by the mixed food mass M+F that arrives from the chamber 21.

Advantageously, according to the disclosure, the mixing portion 2 and the dosage portion 3 have a selective fluid connection, a flow control valve 7 being provided between the two portions 2 and 3.

The flow control valve 7 is preferably an on/off valve.

In this manner, in operation, it is possible to feed the dosage duct 31 with consecutive loads of mixed food mass M+F. Each load fed to the dosage duct 31 has a volume that is approximately equal to the volume of the mixing chamber 21.

An operation with consecutive loads is thus achieved, which causes, during mixing, the ingredients M and F to remain proximate to the mixer 22, achieving an optimum uniform mixture.

This advantage is rendered more evident when the volume of the load (i.e., the volume of the mixing chamber 21) is a multiple of a single dose dispensed in a container V: in this manner, while the dosage portion 3 of the apparatus dispenses the individual doses that compose a first load of mixed food mass M+F, a second load of mixed food mass M+F is mixed—simultaneously—in the chamber 21, where it therefore remains for a time which, as a whole, is longer than if the dosage portion 3 had a permanent fluid connection to the mixing portion 2.

As regards the mixer 22, in a preferred embodiment it is preferably of the magnetic type and comprises helical rotor elements which are mounted so they can rotate on a fixed stator in the chamber 21 and are actuated by means of a variable magnetic field applied, for example, by magnetic coils 25 which are external to the chamber 21; in this manner, the steps of cleaning and sterilizing the apparatus 1 are simplified.

In one variation, instead, the mixer 22 comprises helical elements which are actuated by a motor which is external to the chamber 21 (due to hygiene requirements) and are connected to said motor by means of a transmission shaft which enters the chamber 21.

In order to optimize the batch operation that has just been described, optionally the mixing-dosage apparatus 1 comprises a dosage element 8 which acts on the dosage duct 31 at least to draw from the mixing chamber 21 a load of mixed food mass M+F, in the condition in which the flow control valve 7 is open and the dispensing valve 32 is closed.

Although in principle it is possible to provide different types of dosage element 8, adapted to perform the function that has just been indicated, in the preferred and non-limiting solution shown it is a volumetric machine which has a capacity approximately equal to the volume of a load of mixed food mass M+F.

Preferably, furthermore, the mixing chamber 21 has a volume that is approximately equal to the capacity of the dosage element 8, so that each transfer of a load of mixed food mass M+F from the chamber 21 to the dosage portion 3 is matched by an emptying of the chamber 21, which empties itself of the mixed food mass M+F that has already been processed and fills itself with new ingredients for a new cycle.

As regards the volumetric machine that provides the dosage element 8, in principle it can be provided in various manners; however, in the preferred solution it is of the reciprocating type and comprises a piston 81 which can move in a cylinder 82.

Said cylinder has a fluid connection with the dosage duct 31 in a portion thereof that is comprised between the flow control valve 7 and the dispensing valve 32. In this manner, when the dispensing valve 32 is closed and the flow control valve 7 is open and the piston 81 moves toward the bottom dead center, clearing the cavity of the cylinder 82, a suction of a load of a mixed food mass M+F having a volume approximately equal to the capacity of the dosage element 8 is generated, with the consequence that—if the chamber 21 has an equal volume—it is emptied completely and receives the new ingredients M and F to be mixed.

Moving on now to FIG. 2, it shows a schematic view of parts of a rotary mixing-dosage station 10 for packaging lines of containers V, which comprises at least one mixing-dosage apparatus 1 according to the disclosure.

The station comprises a carousel which is mounted so that it can rotate about a vertical axis Y, which is central with respect to the pitch circle of the carousel.

The carousel is provided at least with one unit for loading containers V, which comprises at least one supporting device 11 for a container V, such as for example a caliper or the like. The container V that can be used in the disclosure can be rigid or flexible.

Preferably, the station 10 comprises a plurality of mixing-dosage apparatuses 1 and a corresponding plurality of supporting devices 11, which are installed so as to cooperate with each other at spaced circumferential positions on the carousel. Functionally, each container V is loaded onto the carousel, supported by a corresponding supporting device 11, filled while it travels along a circular arc and then released to a subsequent processing station, for example a station for the transfer and/or sealing of the filled containers.

On the carousel, the free end of the dosage duct 31 (with or without dispensing nozzle) ends substantially at the supporting device 11 of the container V, in order to allow the filling of the latter by dispensing a dose of mixed food mass M+F.

The station 10 further comprises at least one first tank 4 for the first ingredient M (for example milk or yogurt) and at least one second tank 5 for the second ingredient F (for example fruit in chunks). Generally speaking, the ingredients M and F are mutually different and have different viscosity and/or density characteristics.

The tanks 4 and 5 are mounted so that they can rotate together with the carousel about the same vertical axis Y.

In this embodiment, the tanks 4 and 5 are pressurized tanks, adapted to contain respectively the first and second ingredients at a respective pressure Pm and Pf that is higher than the ambient pressure.

For this purpose, the tanks 4 and 5 form a volume which is closed and sealed toward the outside environment. The respective ingredients are fed by means of the respective supply ducts 41 and 51, which are fixed and connected to the respective tank by means of rotatable coupling flanges 45 and 55, of a per se known type.

Preferably, in order to obtain better results in terms of load distribution, the tanks 4 and 5 have symmetrical shapes with respect to the rotation axis Y, so as to allow the carousel to rotate even at high speed without triggering vibrations.

The tanks 4 and 5 are connected to the mixing chamber 21 in order to feed the latter at least with the first and second ingredients.

In particular, since in the preferred solution the mixing chamber 21 has a vertical extension and the mixer 22 rotates about an axis which is parallel to the axis Y, the tank 4 is axially connected to the chamber 21, at its upper end, while the tank 5 is connected radially to the chamber 21, proximate to its upper end.

The tank 4 is preferably connected directly to the chamber 21 and optionally it is possible to provide an adjustment valve 42 between the two.

The tank 5 is preferably connected to the chamber 21 by means of a duct on which a flow regulator 53 and a flow adjustment valve 52, preferably of the pneumatic type, act.

In operation, the chamber 21 is fed with the first ingredient M at a pressure Pm and with the second ingredient F at the pressure Pf. In order to allow correct feeding and avoid reverse flows of the second ingredient (backward, from the chamber 21 to the tank 5), the pressure Pf is preferably kept higher than the pressure Pm.

For this purpose, the tanks 4 and 5 are functionally connected to respective sources of a first ingredient M at a pressure Pm and of a second ingredient F at a pressure Pf, such as pumps or the like.

The proportion between the mass quantities of the first and second ingredients is instead adjusted appropriately by means of the flow regulator 53, which can comprise a device for measuring mass, time or the like and adjust accordingly the opening/closure of the adjustment valve 52, preferably of the on/off type.

The operation of the apparatus 1 when installed on the station 10 is described hereinafter and provides the method according to the disclosure.

In accordance with the latter, the method is performed in a mixing-dosage apparatus 1, and said apparatus 1 comprises, mounted on a carousel which can rotate with a continuous motion:

a mixing portion 2, provided at least with a mixing chamber 21 and a mixer 22 which is active in the latter, a dosage portion 3, which comprises a dosage duct 31 and a dispensing valve 32 which affects a free end of the dosage duct 31, the mixing portion 2 and the dosage portion 3 having a selective fluid connection, a flow control valve 7 being provided between the two portions 2, 3;

the method comprising the steps of:

-a- introducing at least two ingredients M, F in the mixing chamber 21,

-b- mixing said ingredients with the mixer 22 in order to generate a load of mixed food mass M+F, -c- transferring the entire load of mixed food mass M+F into the dosage portion 3, simultaneously feeding new ingredients M, F into the mixing chamber 21, -d- dispensing from the dosage portion 3 individual doses of mixed food mass M+F to a container V.

Preferably steps -a- and -c- are performed simultaneously.

Preferably, step -a- is performed with the flow control valve 7 open and the dispensing valve 32 closed, while step -b- is performed with the flow control valve 7 closed.

Preferably, step -b- is performed with the flow control valve 7 closed and the dispensing valve 32 alternately open and closed, for the dispensing of individual doses of mixed food mass M+F, wherein each dose corresponds to a fraction of said load of mixed food mass M+F.

Preferably, at least steps -a- and -c- are performed by means of a volumetric machine 8; preferably, step -d- also is performed by means of the volumetric machine 8.

Preferably, the volumetric machine 8 is a reciprocating volumetric machine which acts in the dosage portion 3.

Preferably, the ingredients M, F are fed to the chamber 21 at respective pressures Pm, Pf which are mutually different, preferably Pf>Pm.

In practice it is been found that the disclosure achieves the intended aim and advantages, since it allows to achieve high efficiency in packaging together with uniform mixing, at the same time avoiding damage to the ingredients.

Another advantage of the disclosure is to provide a mixing-dosage apparatus for rotary packaging machines that is mechanically relatively simple and sturdy.

The mixing-dosage apparatus, the station and the method thus conceived are susceptible of numerous modifications and variations, all of which are within the scope of the appended claims.

Furthermore, all the details may be replaced with other technically equivalent elements.

In practice, the materials used, so long as they are compatible with the specific use, as well as the contingent shapes and dimensions, may be any according to the requirements.

The disclosures in Italian Patent Application No. 102017000065679 from which this application claims priority are incorporated herein by reference.

The invention claimed is:

1. A mixing-dosage apparatus for rotary machines for packaging containers that are each configured to be filled with a single dose of mixed food mass, comprising at least one first ingredient and one second ingredient, the mixing-dosage apparatus comprising:

a mixing portion, comprising a mixing chamber and a mixer which is active in the mixing chamber for mixing or blending the ingredients into a mixed food mass, and a dosage portion, comprising a dosage duct and a dispensing valve that affects a free end of the dosage duct to dispense a single dose of mixed food mass in the container, wherein the mixing portion and the dosage portion have a selective fluid connection, a flow control valve being provided between the two portions so as to feed the dosage duct with consecutive loads of mixed food mass, each load having a volume that is approximately equal to the volume of the mixing chamber, and further comprising a dosage element which acts on the dosage duct at least to pick up from said mixing chamber a load of mixed food mass in the condition in which the flow control valve is open and the dispensing valve is closed.

2. The mixing-dosage apparatus according to claim 1, wherein said dosage element is a volumetric machine that has a capacity approximately equal to that of a load of mixed food mass.

3. The mixing-dosage apparatus according to claim 2, wherein the mixing chamber has a volume approximately equal to the capacity of the dosage element.

4. The mixing-dosage apparatus according to claim 1, wherein the dosage element comprises a piston configured to move in a cylinder, said cylinder having a fluid connection to said dosage duct in a portion of said dosage duct comprised between the flow control valve and the dispensing valve.

5. A rotary mixing-dosage station for lines for filling containers, the rotary mixing-dosage station comprising:

at least one first tank for a first ingredient and at least one second tank for a second ingredient; and a carousel configured to rotate about a vertical axis and is provided along its peripheral region with a plurality of filling nozzles associated with respective devices for supporting the containers, wherein each one of said nozzles is connected to said at least one first tank and to said at least one second tank at least through a respective mixing portion which is fixed to said carousel and comprising a mixing chamber and a mixer which is active in the mixing chamber to mix or blend said first and second ingredients into a mixed food mass configured to be dispensed from said nozzle, wherein at least said first tank and said second tank are pressurized tanks and are connected respectively to a source of a first ingredient under pressure and to a source of a second ingredient under pressure.

6. The rotary mixing-dosage station according to claim 5, wherein each one of said container supporting devices comprises at least one device for supporting a container, said nozzle being arranged at said supporting device of the container to allow the filling of the latter by dispensing said dose of mixed food mass.

7. A mixing-dosage method in a packaging machine, wherein the method is performed in a mixing-dosage apparatus according to claim 1, the method including the following steps:

-a- introducing at least two ingredients in the mixing chamber,

-b- mixing the ingredients with the mixer to generate a load of mixed food mass, -c- transferring the entire load of mixed food mass into the dosage portion, simultaneously feeding new ingredients into the mixing chamber, and -d- dispensing from the dosage portion individual doses of mixed food mass to a container with the dosage element acting on the dosage duct while the dispensing valve is closed.

8. The mixing-dosage method according to claim 7, wherein steps -a- and -c- are performed simultaneously.

9. The mixing-dosage method according to claim 7, wherein step -a- is performed with the flow control valve open and the dispensing valve closed, while step -b- is performed with the flow control valve closed.

10. The mixing-dosage method according to claim 7, wherein the steps -a- to -d- are performed while the mixing-dosage apparatus rotates continuously about a rotation axis of a carousel on which the mixing-dosage apparatus is mounted.

* * * * *